US007821372B2

(12) United States Patent
Ho-Hsiang

(10) Patent No.: US 7,821,372 B2
(45) Date of Patent: Oct. 26, 2010

(54) ON-CHIP TRANSFORMER BALUN STRUCTURES

(75) Inventor: Chen Ho-Hsiang, Hsinchu (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 62 days.

(21) Appl. No.: 12/347,569

(22) Filed: Dec. 31, 2008

(65) Prior Publication Data

US 2010/0164667 A1 Jul. 1, 2010

(51) Int. Cl.
*H01F 5/00* (2006.01)

(52) U.S. Cl. ..... 336/200

(58) Field of Classification Search ..... 336/65, 336/200, 206–208, 232; 257/531
See application file for complete search history.

(56) References Cited

U.S. PATENT DOCUMENTS 4,816,784 A * 3/1989 Rabjohn ..... 333/24 R
5,877,667 A 3/1999 Wollesen
6,097,273 A * 8/2000 Frye et al. ..... 336/200
6,188,306 B1 2/2001 Wollesen
6,380,821 B1 4/2002 Imbornnone et al.
6,577,219 B2 * 6/2003 Visser ..... 336/200
6,603,383 B2 8/2003 Gevorgian et al.
6,653,910 B2 * 11/2003 Escalera et al. ..... 333/26
6,794,977 B2 * 9/2004 Christensen ..... 336/200
6,943,658 B2 * 9/2005 Gardner ..... 336/200
7,088,214 B2 * 8/2006 Castaneda et al. ..... 336/200
7,164,339 B2 1/2007 Huang
7,171,739 B2 2/2007 Yang et al.
7,184,735 B2 2/2007 Bhatti et al.
7,253,712 B1 8/2007 Papananos

* cited by examiner

*Primary Examiner*—Tuyen Nguyen
(74) *Attorney, Agent, or Firm*—Duane Morris LLP

(57) ABSTRACT

An electronic device includes a first winding having a first port and a second port. The first winding formed in a first metal layer. A second winding has a third port and a fourth port. The second winding includes a plurality of segments formed in the first metal layer. The second plurality of winding segments are connected by a bridge formed in a second metal layer. The first and second ports of the first winding are connected to the inner-portion of the first winding.

18 Claims, 17 Drawing Sheets

ON-CHIP TRANSFORMER BALUN STRUCTURES

FIELD OF DISCLOSURE

The disclosed system and method relate to transformers and balanced-to-unbalanced (BALUN) devices. More specifically, the disclosed system and method relate to on-chip symmetrical transformers and BALUN devices.

BACKGROUND

Transformers and balanced-to-unbalanced (BALUN) devices are commonly used in wireless communications. For example, transformers and BALUNS are frequently used in transceivers in wireless communication devices as illustrated in FIGS. 11 and 12. As shown in FIG. 12, the modulator includes a conventional BALUN K0 having a center tap CTP connected to Vdd1. Conventional coplanar interleaved transformers used in such applications have the primary and secondary windings interleaved on the same integrated circuit layer. The primary and secondary windings are constructed of planar metal traces.

FIG. 1A illustrates a conventional coplanar symmetric transformer 100 having a 2:2 turn ratio. As shown in FIG. 1A, the transformer 100 includes a primary winding 102 and a secondary winding 106, which are both located on the same metal layer. The segments 102*a*, 102*b*, 102*c*, and 102*d* that comprise primary winding 102 are connected by metal bridges 104*a*, 104*b*, and 104*c* formed on a separate metal layer and connecting vias (not shown). Similarly, the secondary winding 106 is comprised of segments 106*a*, 106*b*, 106*c*, and 106*d* that are formed on the same metal layer as the segments comprising the primary winding 106. Additionally, metal bridges 108*a*, 108*b*, and 108*c* that connect the segments 106*a*, 106*b*, 106*c*, and 106 that form secondary winding 106 are formed on the same metal layer on which metal bridges 104*a*, 104*b*, and 104*c* are formed. While conventional coplanar interleaved transformers reduce the size and resistance, they suffer from low quality (Q) factors and small coupling coefficients.

FIG. 1B illustrates a conventional coplanar BALUN device 150 having a 2:2 turn ratio. BALUN device 150 includes a primary winding 152 and a secondary winding 156. Primary winding 152 includes winding segments 152*a*, 152*b*, 152*c*, 152*d*, and 152*e*, which are formed on a first metal layer and are connected by metal bridges 104*a*, 104*b*, and 104*c* formed on a second metal layer. Center tap 160 is formed on a third metal layer and connects primary winding segments 152*b* and 152*c*.

Secondary winding 156 is also formed from a plurality of winding segments 156*a*, 156*b*, 156*c*, 156*d*, and 156*e* formed on the same metal layer as primary winding 152. Secondary winding segments 156*a-e* are connected by metal bridges 158*a*, 158*b*, and 158*c* located on the same metal layer as metal bridges 154*a-c*. Center tap 162 is formed on the same metal layer as center tap 160 and connects winding segments 156*b* and 156*c*.

As shown in FIG. 1B, the center taps 160 and 162 are connected at the inner-most portion of the BALUN 150 and extend to the outer-most portion. This center tap location is an undesirable location as it may result in high current density on the center taps 160, 162, which may have a detrimental affect on the reliability of the circuit due to electromigration. For example, the reliability of a transceiver circuit as illustrated in FIG. 12 would be detrimentally affected if a BALUN 150, as illustrated in FIG. 1B, were implemented as the BALUN in FIG. 12 as the location of the center tap 160, e.g., CTP in FIG. 12, would have a high current density. Additionally, if the BALUN illustrated in FIG. 12 included a center tap on the secondary winding (CTS) as shown in FIG. 1B, e.g., center tap 162 in FIG. 1B, the reliability of the transceiver circuit would be reduced.

Accordingly, improved transformers and BALUNs are desired.

SUMMARY

In one embodiment, an electronic device includes a first winding having a first port and a second port. The first winding formed in a first metal layer formed over a semiconductor substrate. A second winding has a third port and a fourth port. The second winding includes a plurality of segments formed in the first metal layer. The second plurality of winding segments is connected by a bridge formed in a second metal layer. The first and second ports of the first winding are connected to the inner-portion of the first winding.

In one embodiment, a two metal-layer electronic device comprises a primary winding having a first set of ports. The primary winding includes a first plurality of winding segments formed in a first metal layer formed over a semiconductor substrate. A first plurality of bridges is formed in a second metal layer. The first plurality of bridges connects the first plurality of winding segments. A secondary winding has a second set of ports. The secondary winding includes a second plurality of winding segments formed in the first metal layer. A second plurality of bridges is formed in the second metal layer. The second plurality of bridges connects the second plurality of winding segments. The first set of ports is located at the innermost portion of the primary winding.

DETAILED DESCRIPTION

Figure 1B:
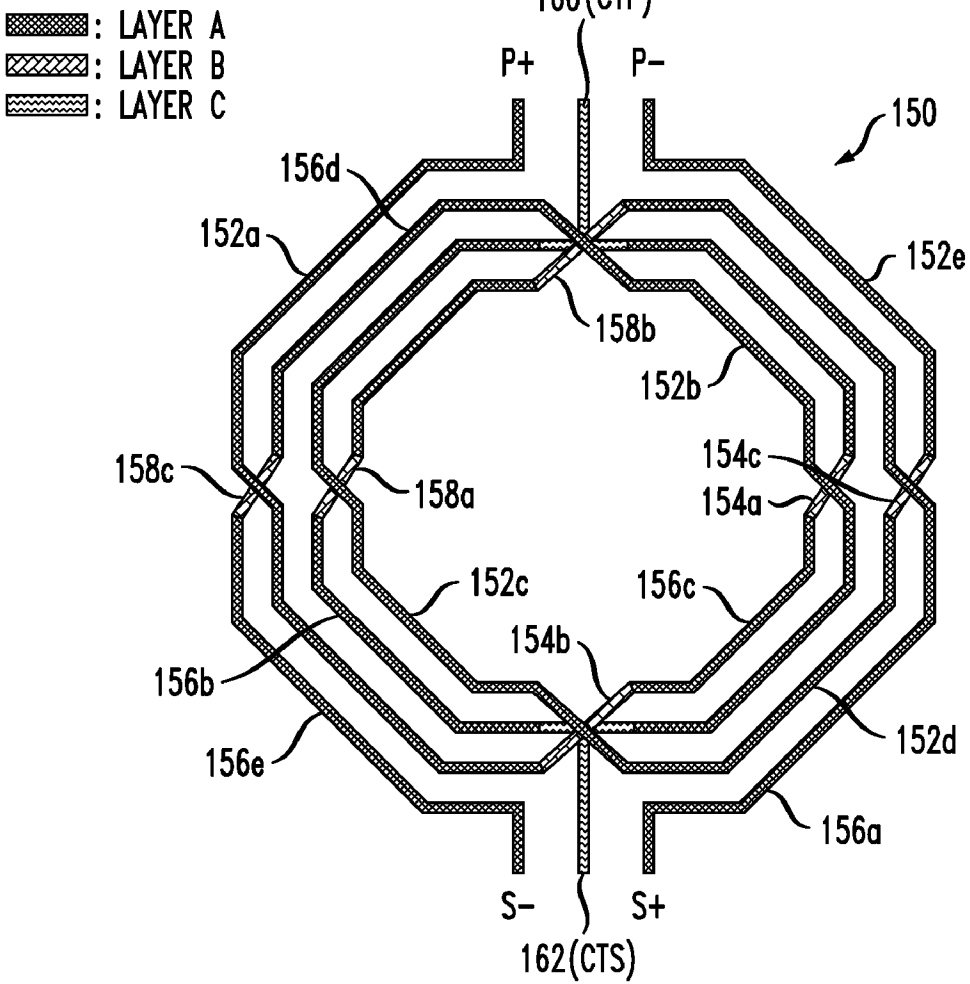
FIG. 1B (PRIOR ART)
FIG. 1B is a top view of a conventional on-chip BALUN.
Figure 1A:
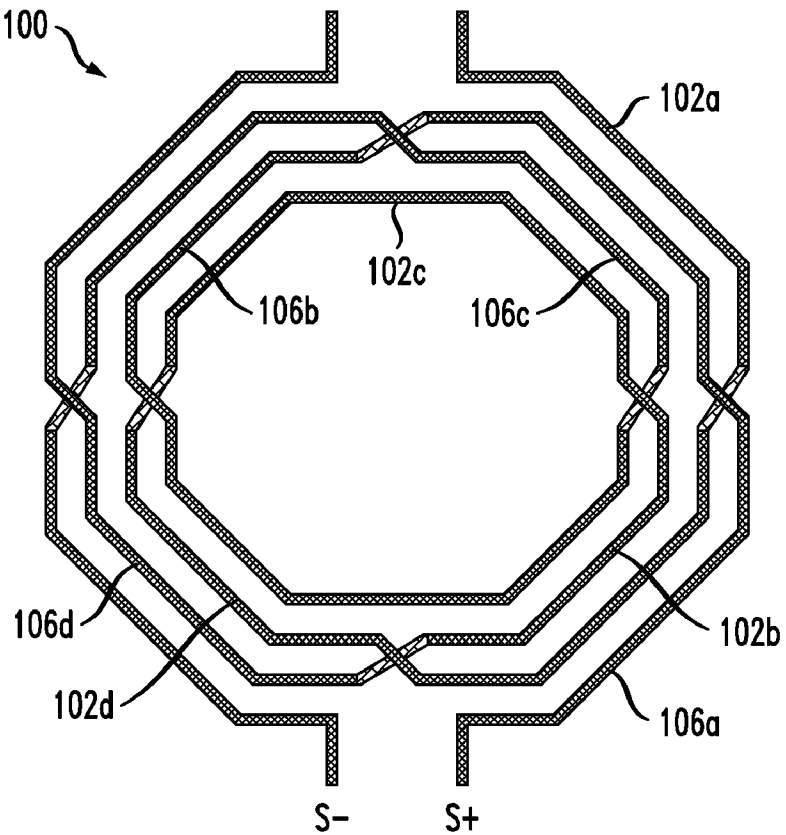
FIG. 1A (PRIOR ART)
FIG. 1A is a top view of a conventional on-chip transformer.
Figure 2A:
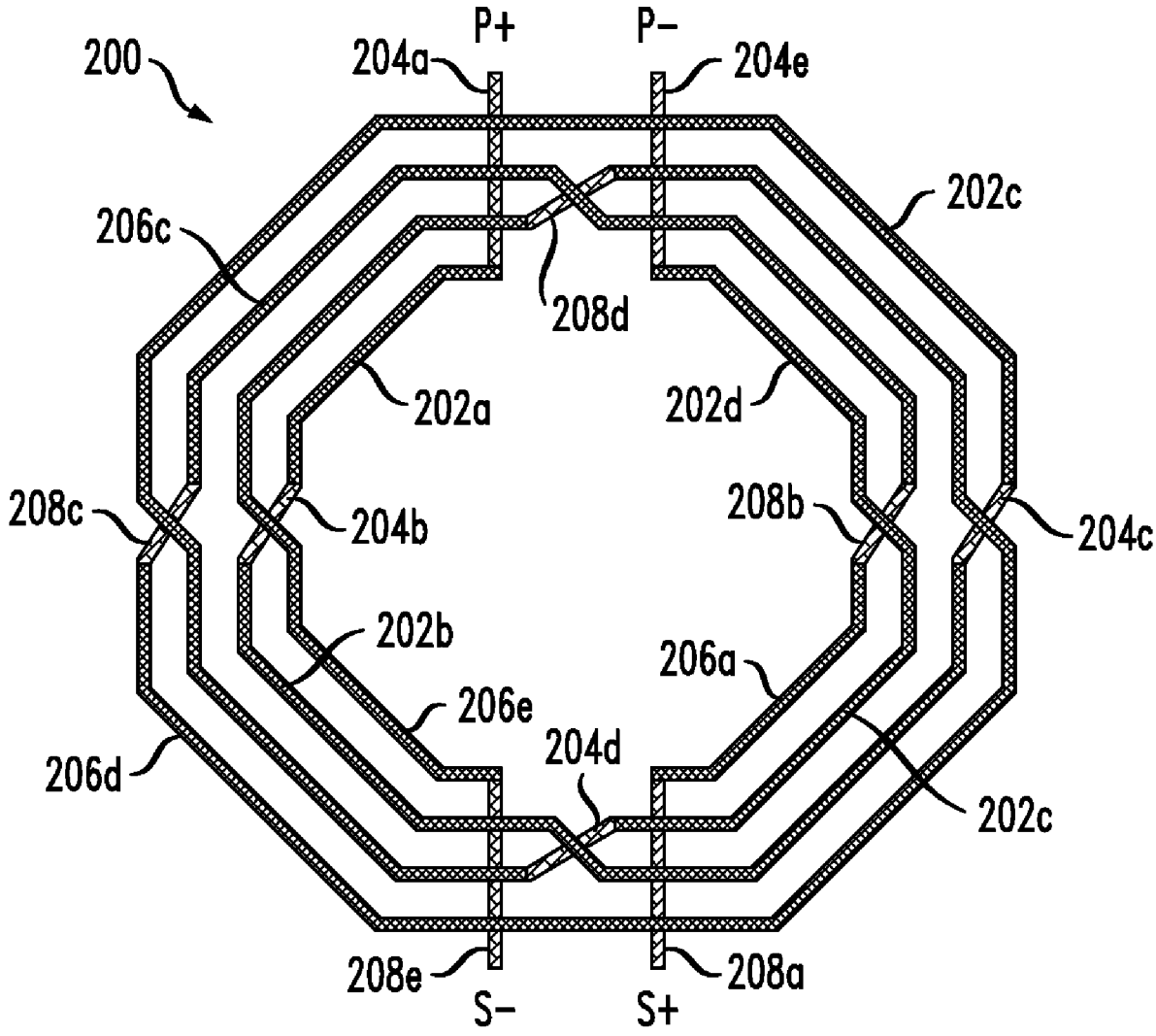
FIG. 2A is a top view of a transformer having a 2:2 turn ratio in accordance with the present disclosure.
Figure 2B:
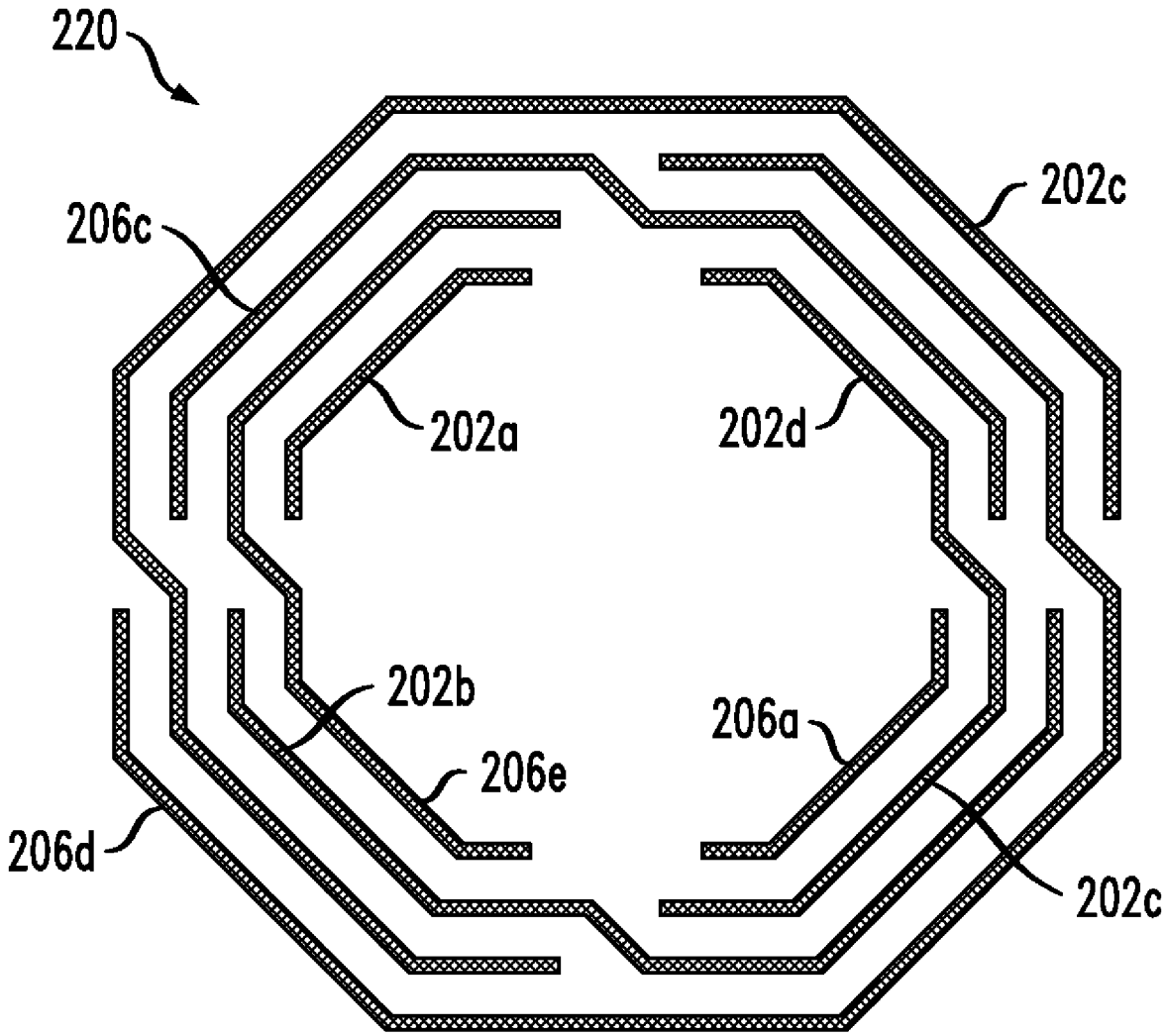
FIG. 2B illustrates the first metal layer pattern of the transformer illustrated in FIG. 2A.
Figure 2C:
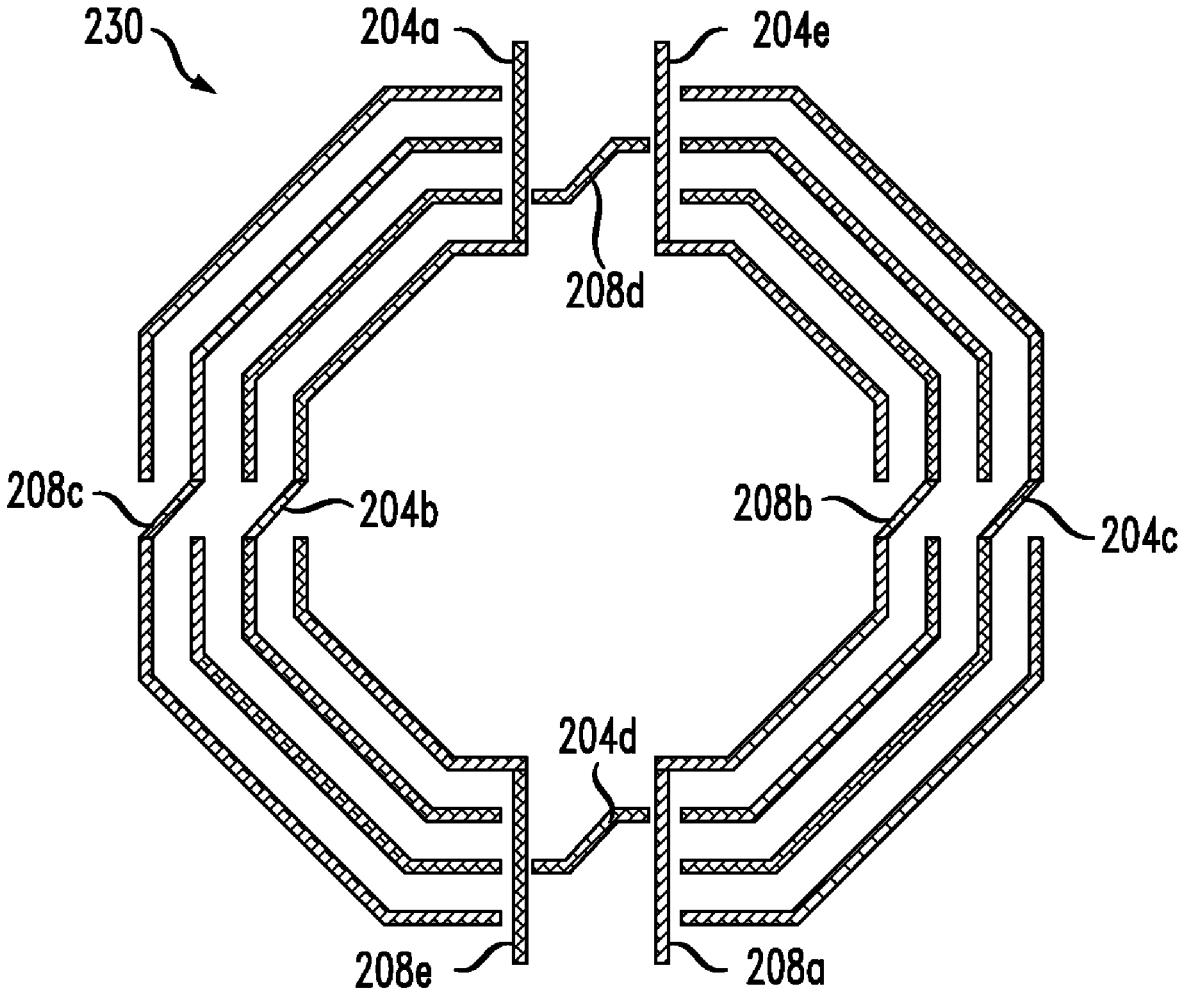
FIG. 2C illustrates the second metal layer pattern of the transformer illustrated in FIG. 2A.
Figure 2D:
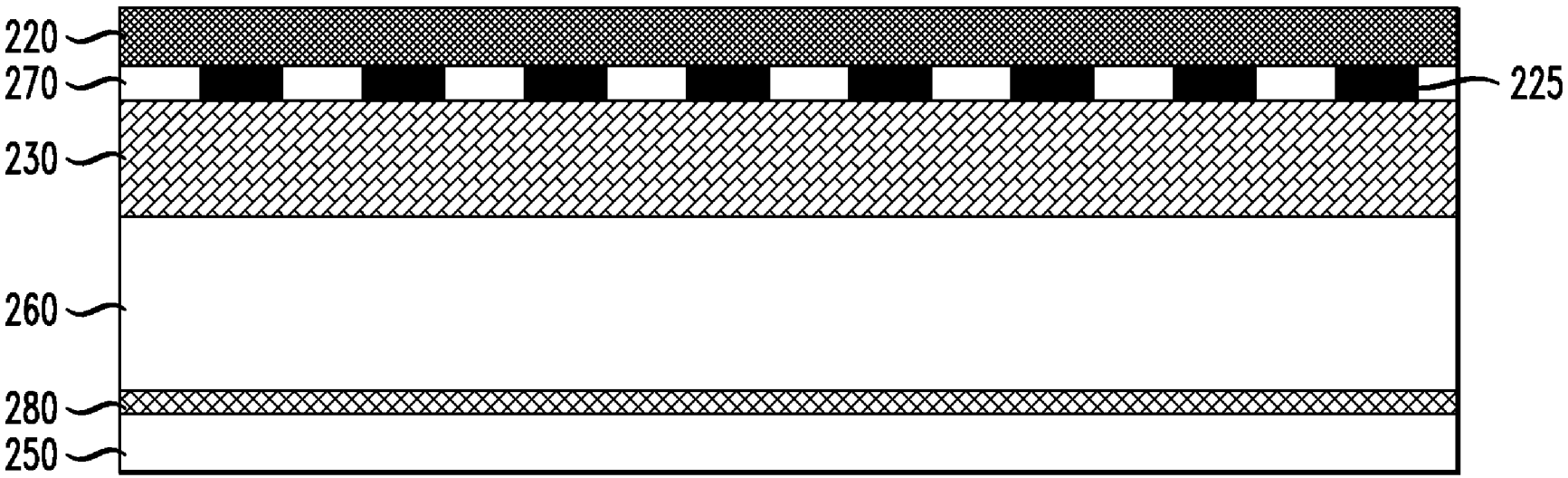
FIG. 2D is a cross-sectional view of the transformer illustrated in FIG. 2A.

An improved system and method of on-chip symmetrical transformers/BALUNS devices are now described. FIG. 2A illustrates one exemplary layout of a symmetric on-chip transformer 200 having a 2:2 turn ratio. Transformer 200 includes a primary winding 202 and a secondary winding 206. Primary winding 202 is formed from winding segments 202*a*, 202*b*, 202*c*, and 202*d* formed on a first metal layer 220 as shown in FIGS. 2B and 2D and on a second metal layer 230 as shown in FIGS. 2C and 2D. Secondary winding 206 is formed on the same metal layers and comprises winding segments 206*a*, 206*b*, 206*c*, and 206*d*. In some embodiments, the primary and secondary windings 202, 206 are formed on a first metal layer 220 which has a thickness between one and three microns and a second metal layer 230 having a thickness between one an three microns. One skilled in the art will understand that the primary and secondary windings 202, 206 may be formed on metal layers having other thicknesses. For example, in some embodiments, the metal patterns shown in FIG. 2B may be formed on the second metal layer 230, and the metal patterns shown in FIG. 2C may be formed on the first metal layer 220. In some embodiments, first metal layer 220 and second metal layer 230 may be connected by one or more vias 225.

Figure 10:
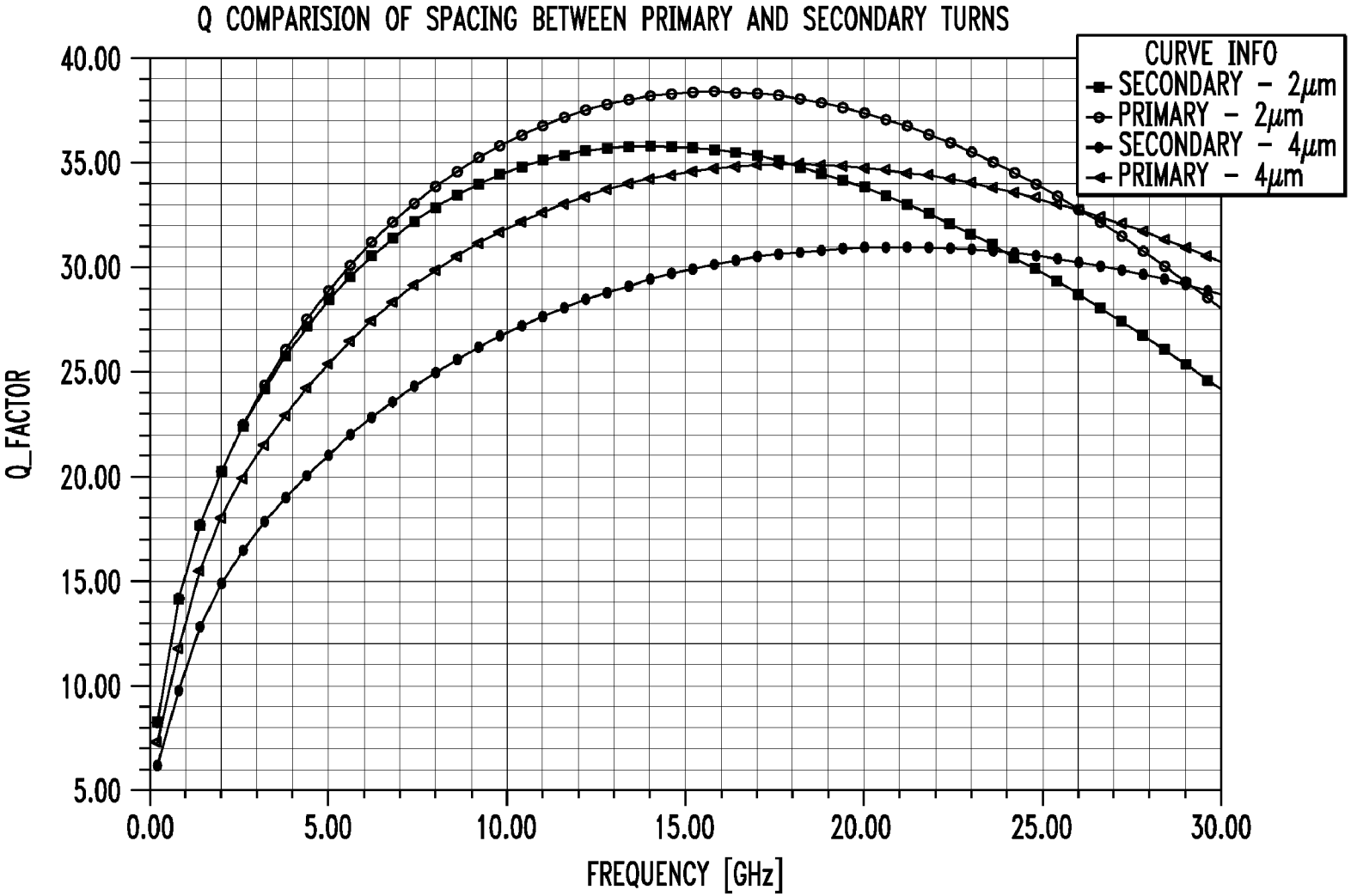
FIG. 10 is a combined graph of quality factor versus frequency and inductance versus frequency.
Figure 11:
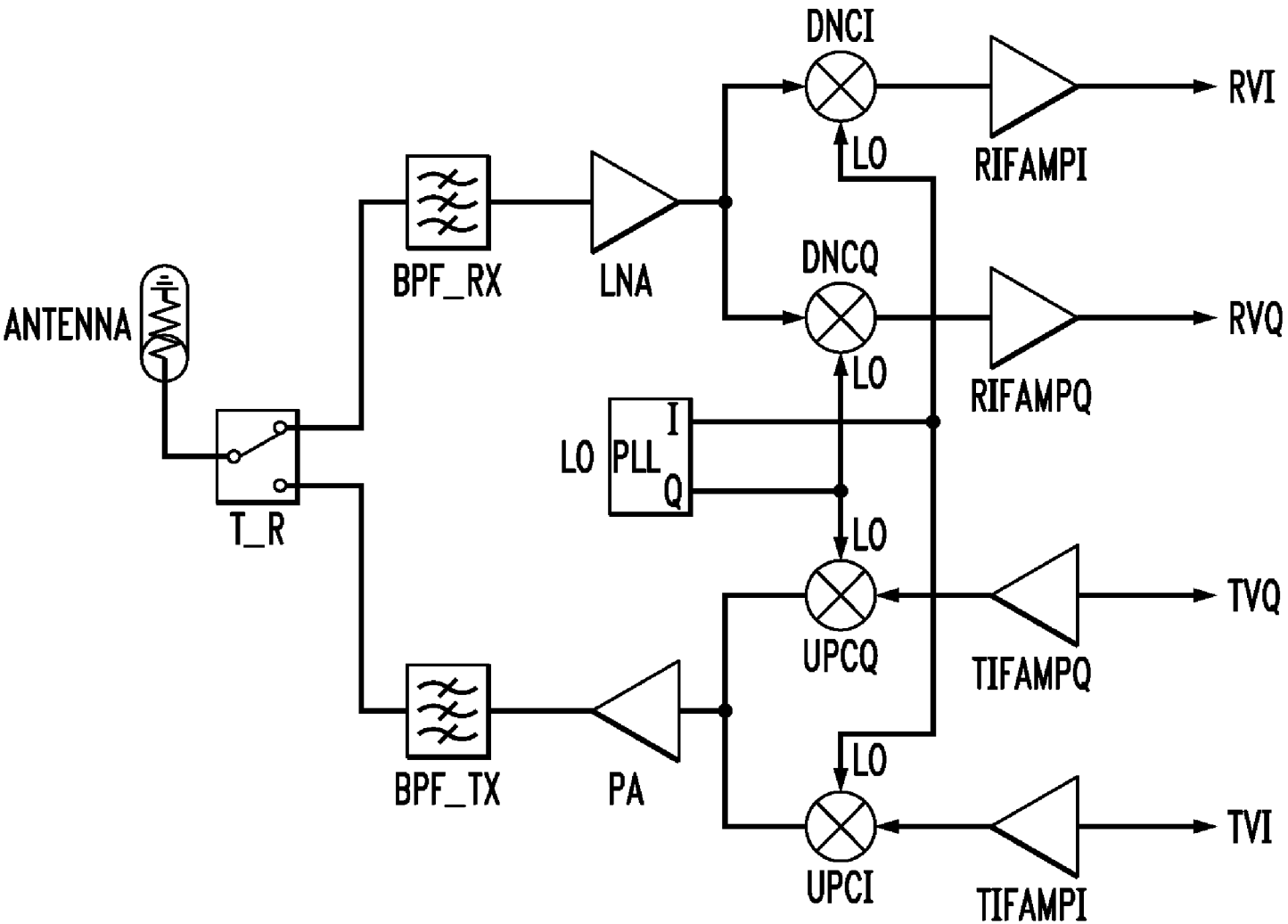
FIG. 11 is a block diagram of a transceiver in which a BALUN or transformer may be implemented.
Figure 12:
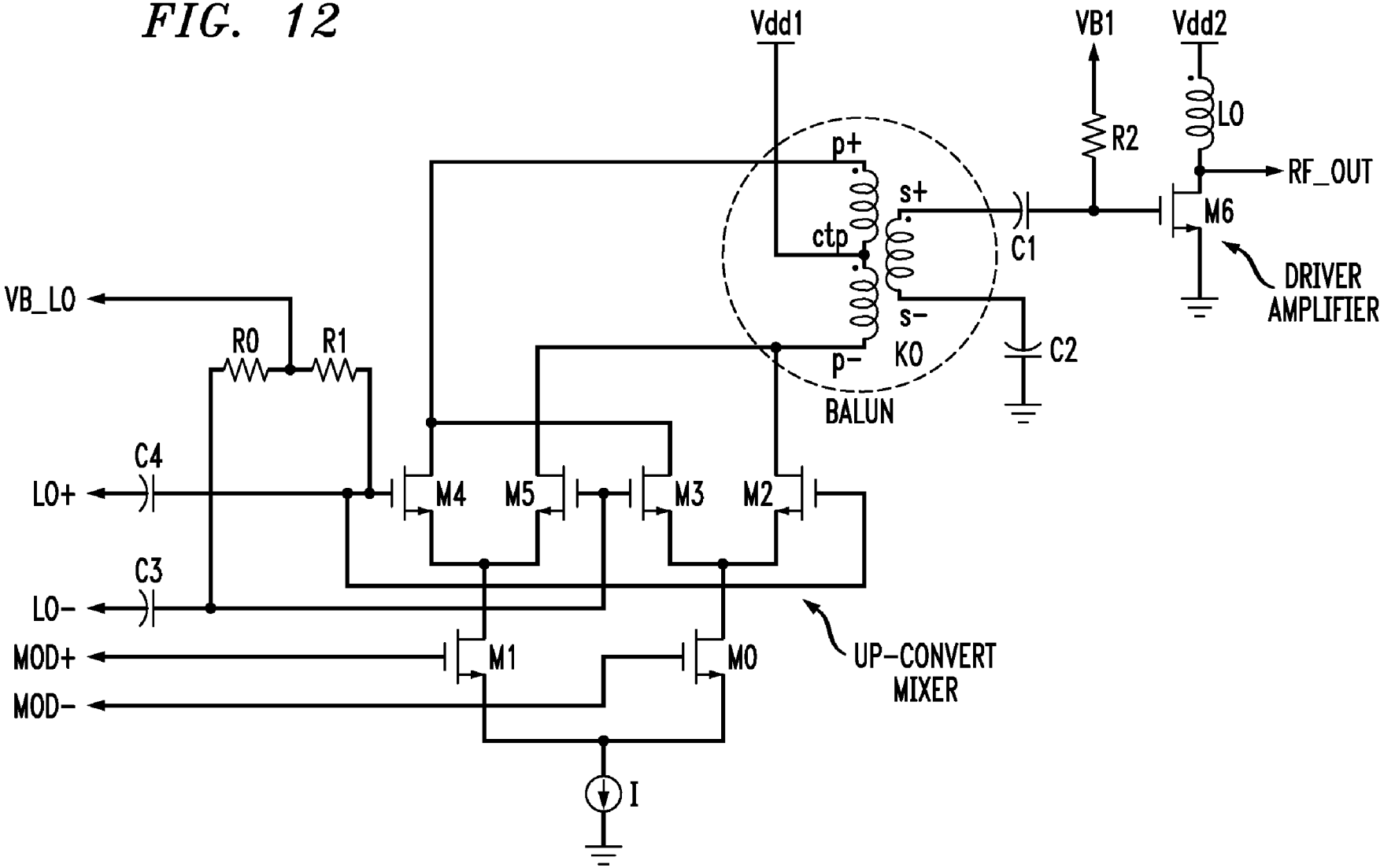
FIG. 12 is a circuit diagram of a mixer circuit of the transceiver illustrated in FIG. 11.

The Q-factor of a transformer or BALUN improves as the thickness of the metal layer on which the windings are formed is increased. FIG. 10 is a graph showing both the Q-factor versus frequency and the inductance versus frequency for primary and secondary windings made using metal layers having different thickness in a transformer having a 2:2 turn ratio. The thin metal layer plot was created with metal layers having a thickness of 1 micron, and the thick metal layer plot was created with metal layers having thickness of microns. As shown in FIG. 10, the Q-factor is higher for the thick metal layers than for thin metal layers for all frequencies.

The winding segments 202*a*-202*d* that comprise the primary winding 202 are connected by metal bridges 204*a*, 204*b*, 204*c*, 204*d*, and 204*e*, which are formed on a second metal layer 230 as illustrated in FIG. 2C. The winding segments 206*a*, 206*b*, 206*c*, and 206*d* that form secondary winding 206 are also connected by metal bridges 208*a*, 208*b*, 208*c*, 208*d*, and 208*e* that are formed on the second metal layer 230 as the layer on which the metal bridges 204*a*-204*c* are formed. The second metal layer 230 on which the metal bridges 204*a*-204*c*, 208*a*-208*c* are formed may also have a thickness between one and three microns although the metal layer may have other thicknesses.

FIG. 2D is a cross-sectional view of the transformer 200 illustrated in FIG. 2A. As shown in FIG. 2D, the two metal layers 220, 230 are vertically stacked over one another and are separated by a dielectric layer 270. Examples of dielectric materials suitable for these layers include, but are not limited to, $SiO_2$, PSG, BPSG, and SiN. The metal layers 220, 230 are formed over a second dielectric layer 260, which is formed over a guard ring 280. Guard ring 280 is formed over a semiconductor substrate 250.

Referring again to FIG. 2A, transformer 200 is formed so that current flows from the inner part of transformer 200 to the outer part of transformer 200. For example, when connected to another circuit or device, current will flow into metal bridge 204*a*, which serves as a port to primary winding 202, and out of metal bridge 204*e* which serves as a second port to primary winding 202. In this manner, current flows from the inner portion to the outer portion of transformer 200. Forming the transformer such that current flows from the inside to the outside of the transformer 200 reduces the current density at the center of the transformer. Reducing the current density at the center of the transformer improves the reliability of the transformer 200 by reducing the likelihood of electromigration. For example, implementing a BALUN or transformer using a metal layer having a thickness of one micron may reduce the current density by a factor of seven, and using a metal layer having a thickness of approximately three microns may reduce the current density by a factor of twenty-five.

Figure 3:
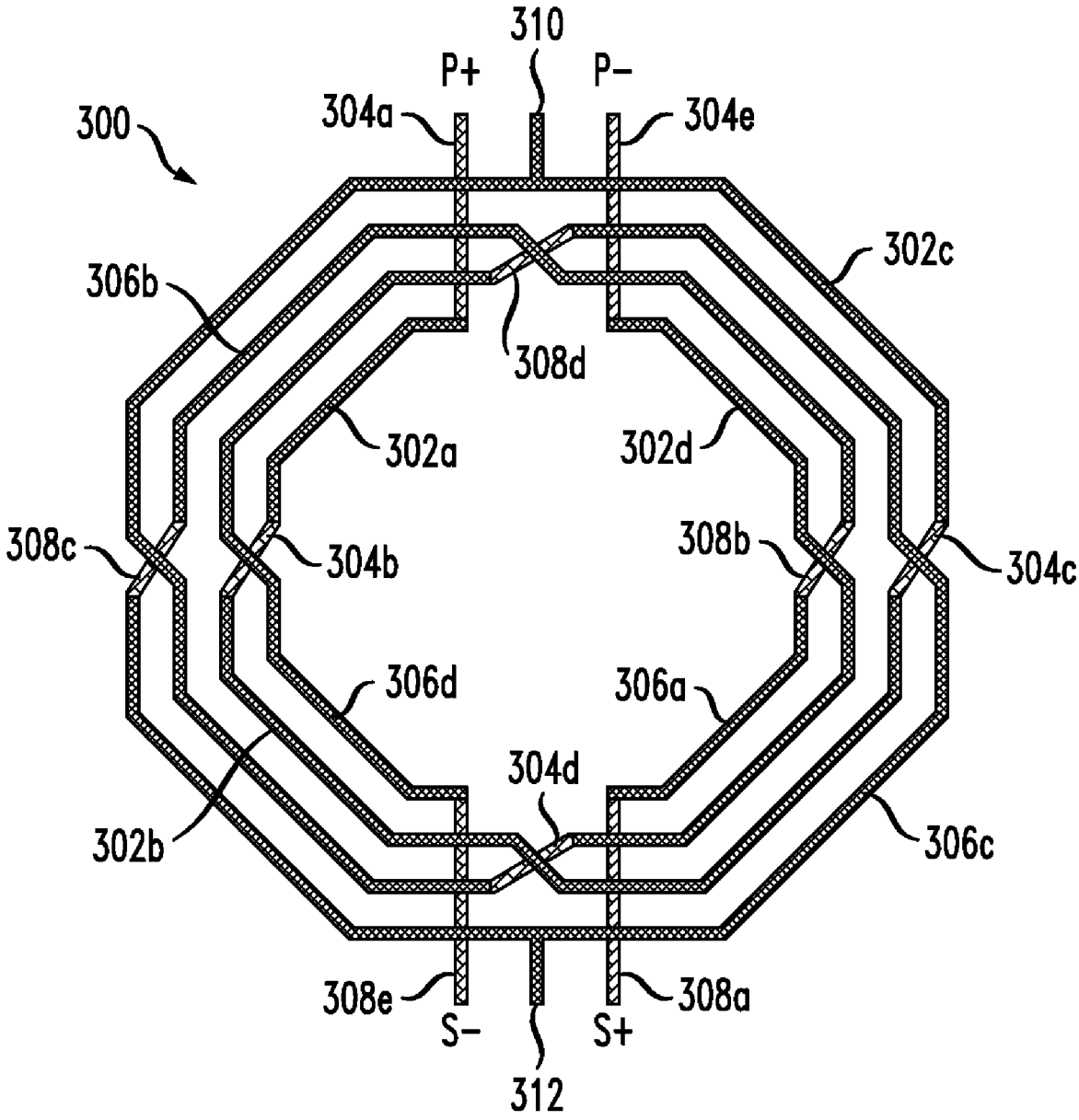
FIG. 3 is a top view of a BALUN device having a 2:2 turn ratio in accordance with the present disclosure.

A BALUN device 300 may be formed in a similar manner to the transformer 200 shown in FIG. 2. Features in FIG. 3 which are identical to those in FIG. 2 are identified by having reference numerals with the same two least significant digits as the features in FIG. 2, but increased by 100. For example, FIG. 3 illustrates a BALUN device 300 having a 2:2 turn ratio formed on only two metal layers, unlike conventional BALUN devices which are formed on three or four metal layers. As shown in FIG. 3, BALUN 300 includes a primary winding 302 comprising winding segments 302*a*, 302*b*, 302*c*, and 302*d*, which are formed on a first metal layer. The primary winding segments 302*a*-302*d* are connected with bridges 304*a*, 304*b*, 304*c*, 304*d*, and 304*e*, which are formed on a second metal layer, which may be formed vertically above or below the first metal layer.

Secondary winding 306 is formed on the same metal layer as primary winding 302 and comprises winding segments 306*a*, 306*b*, 306*c*, and 306*d*. Secondary winding segments 306*a*-306*d* are connected with bridges 308*a*, 308*b*, 308*c*, 308*d*, and 308*e*, which are formed on the second metal layer.

Both the primary winding 302 and the secondary winding 306 have a center tap 310, 312 connected to the outermost portion of the BALUN 306. For example, primary inductor 302 has a center tap 310 connected to winding segment 302*c* located at the outer portion of the BALUN 300, and center tap 312 is connected to winding segment 306*c* located at the outer part of BALUN 300. The configuration of BALUN 300 shown in FIG. 3 enables the BALUN 300 to be formed on only two metal layers thereby reducing the number of metal layers and masking steps needed to create the BALUN. Additionally, locating the center taps at the exterior of the BALUN 300 decreases the current density in center taps 310, 312, which in turn reduces the likelihood of electromigration. Accordingly, as the likelihood of electromigration decreases, the reliability of the BALUN 300 increases.

Figure 4:
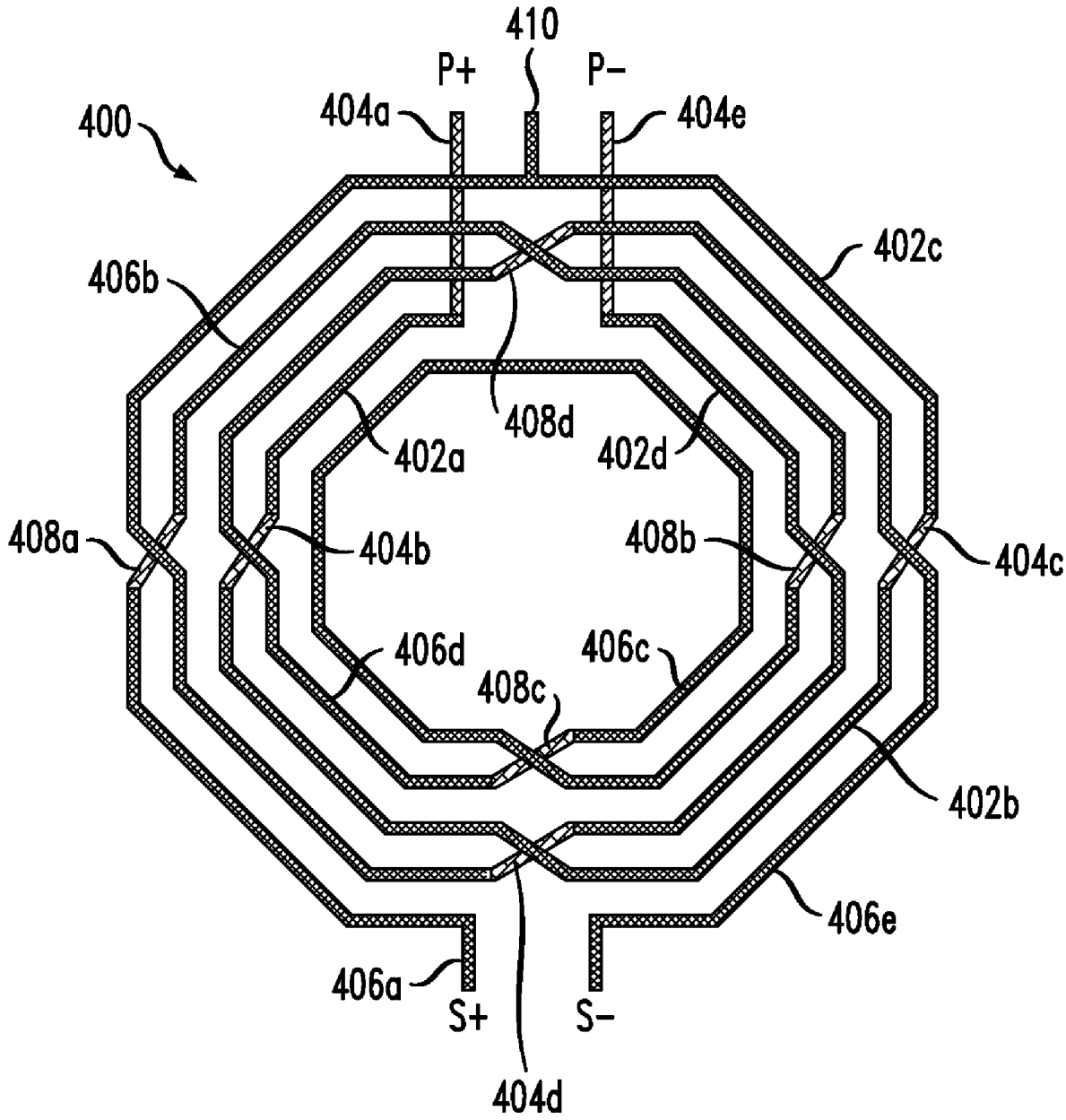
FIG. 4 is a top view of a BALUN having a 2:3 turn ratio in accordance with the present disclosure.

FIG. 4 illustrates one example of a BALUN 400 having a 2:3 turn ratio. Features in FIG. 4 which are identical to those in FIG. 2 are identified by having reference numerals with the same two least significant digits as the features in FIG. 2, but increased by 200. As shown in FIG. 4, BALUN 400 has a primary winding 402 comprising a plurality of winding segments 402*a*, 402*b*, 402*c*, and 402*d* formed on a first metal layer connected by a metal bridges 404*a*, 404*b*, 404*c*, 404*d*, and 404*e* formed on a second metal layer. BALUN 400 also includes a secondary winding 406 comprising a plurality of winding segments 406*a*, 406*b*, 406*c*, 406*d*, and 406*e* formed on the same metal layer as primary winding 402. The windings segments 406*a*-404*e* of secondary winding 406 are connected by metal bridges 408*a*, 408*b*, 408*c*, and 408*d*, which are formed on the same metal layer as metal bridges 404*a*-404*e* that connected primary winding 402. BALUN 400 also includes a center tap 410 connected to primary winding segment 402*c* located at the outer-most portion of the BALUN 400.

Figure 5:
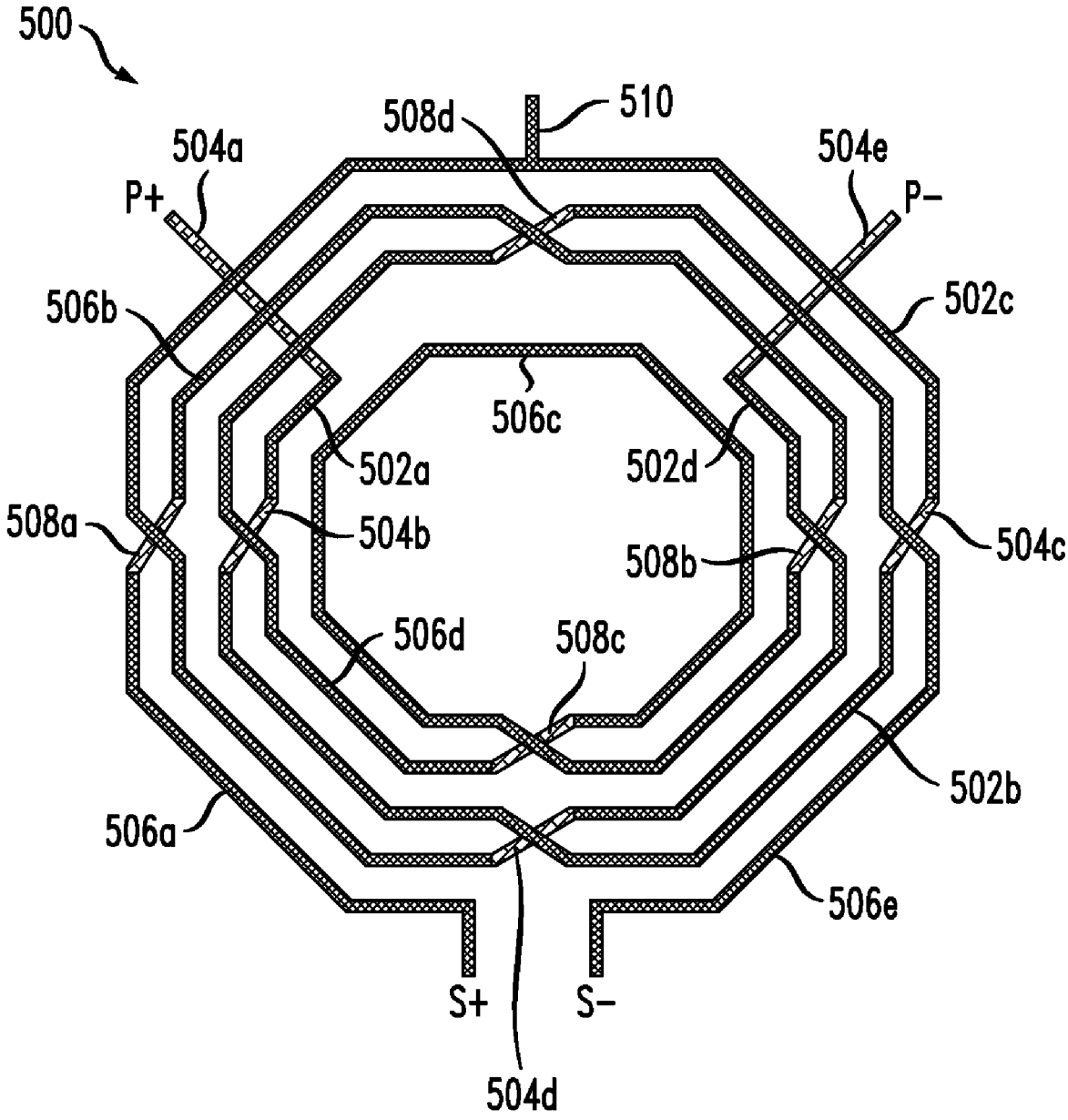
FIG. 5 is a top view of a BALUN having an inductor with a non-integer number of turns in accordance with the present disclosure.

In addition to having different turn ratios, transformers and BALUNS in accordance with the present disclosure may include windings having a non-integer number of turns. For example, FIG. 5 illustrates a BALUN device 500 having a turn ratio of 1.75:3. Features in FIG. 5 which are identical to those in FIG. 2 are identified by having reference numerals with the same two least significant digits as the features in FIG. 2, but increased by 300. As shown in FIG. 5, primary winding 502 includes a plurality of winding segments 502*a*, 502*b*, 502*c*, and 502*d* formed on a first metal layer connected by metal bridges 504*a*, 504*b*, 504*c*, 504*d*, and 504*e* formed on a second metal layer. The primary winding 502 makes a total of 1.75 turns and has its ports 504*a*, 504*e* located at an angle of 90 degrees from one another.

Secondary winding 506 also includes a plurality of winding segments 506*a*, 506*b*, 506*c*, 506*d*, and 506*e* formed on the same metal layer as primary winding 502. The winding segments 506*a*-506*e* are connected by metal bridges 508*a*, 508*b*, 508*c*, and 508*d*, which are formed on the same metal layer as metal bridges 504*a*-504*d*. The secondary winding makes three turns and has its two ports located parallel to one another. A center tap 510 is connected to primary winding segment 502*c*, which is at the outer-most portion of the BALUN 500.

Figure 6:
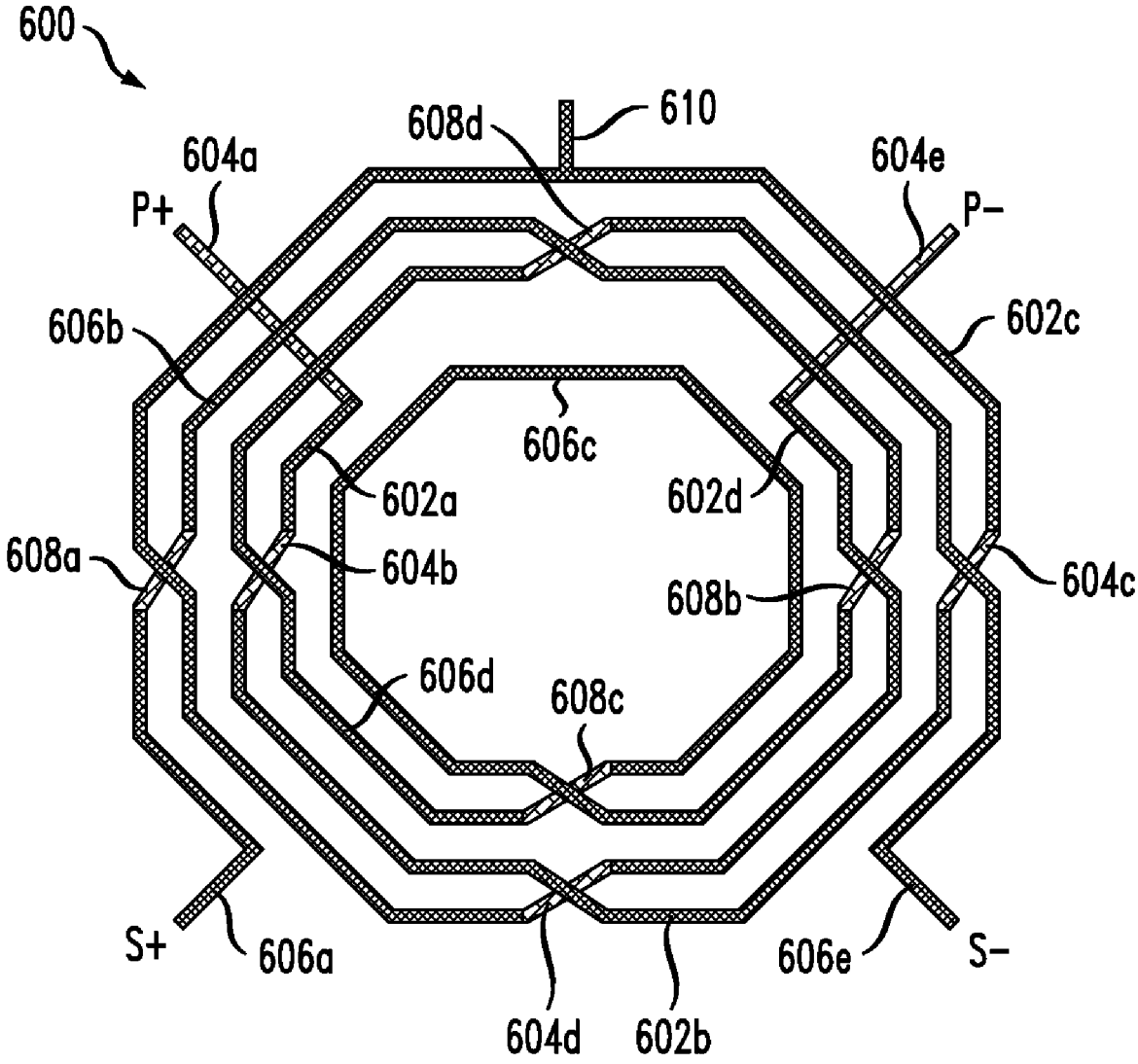
FIG. 6 is a top view of a BALUN with both inductors having non-integer number of turns in accordance with the present disclosure.

FIG. 6 illustrates another embodiment of a BALUN device 600 having windings with non-integer numbers of turns and non-parallel ports. Features in FIG. 6 which are identical to those in FIG. 5 are identified by having reference numerals with the same two least significant digits as the features in FIG. 5, but increased by 100. As shown in FIG. 6, the primary winding 602 of BALUN 600 makes 1.75 turns and the secondary winding 606 makes 2.75 turns. The ports 604*a*, 604*e* of primary winding 602 are disposed at 90 degree angles from one another as are the ports 606*a*, 606*b* for secondary winding 606.

Figure 7:
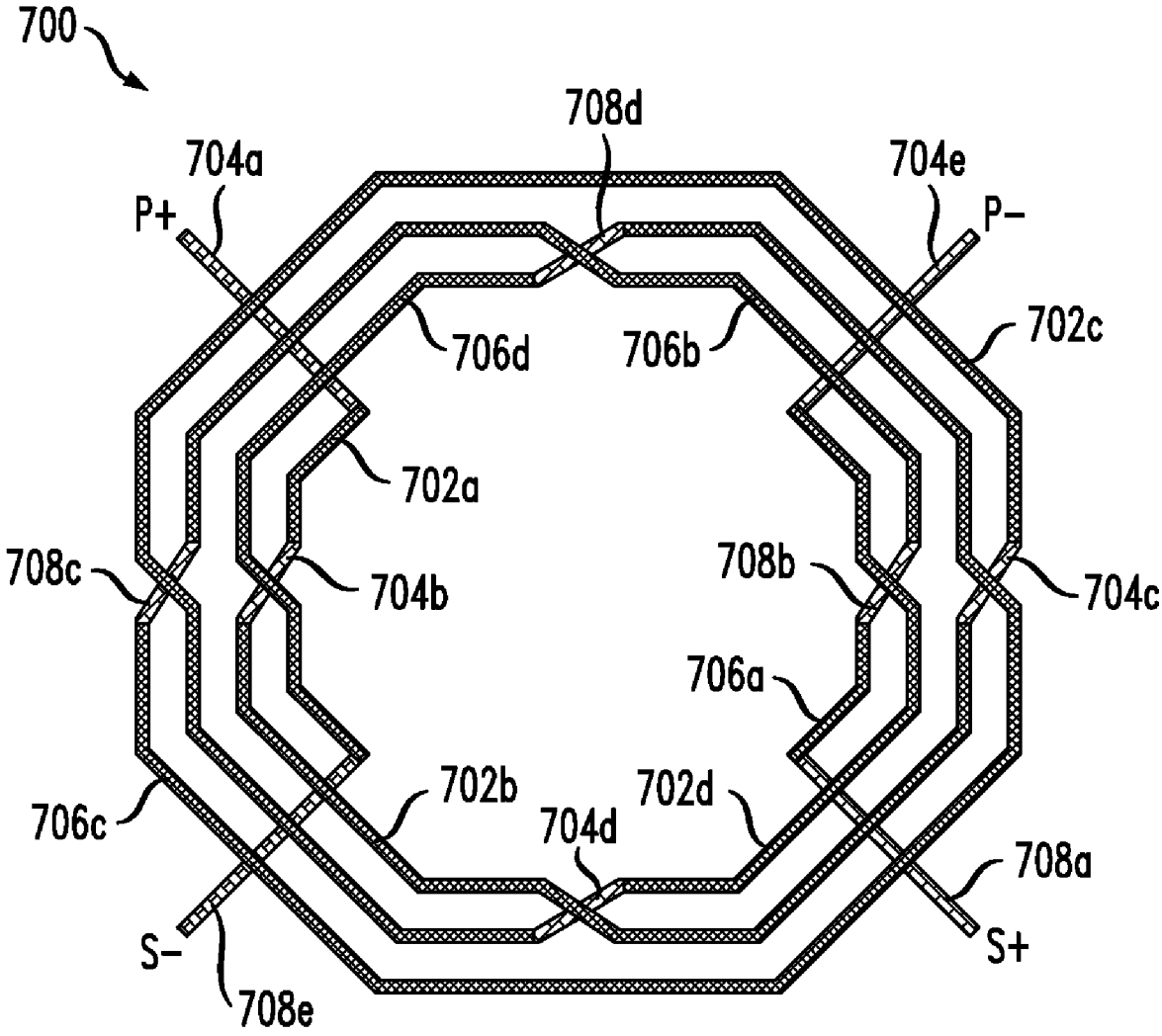
FIG. 7 is a top view of a transformer with both inductors having non-integer number of turns and non-parallel ports in accordance with the present disclosure.

FIG. 7 illustrates an example of a transformer 700 having a 1.75:1.75 turn ratio and non-parallel ports. Features in FIG. 7 which are identical to those in FIG. 6 are identified by having reference numerals with the same two least significant digits as those in FIG. 6, but increased by 100. As shown in FIG. 7, the ports 704*a*, 704*e* of primary winding 702 are disposed at an angle of 90 degrees from one another as are the ports 708*a*, 708*e* of secondary winding 702. Note that the ports 704*a*, 704*e*, 708*a*, 708*e* of the primary winding 702 and secondary winding 706 may be disposed at angles other than 90 degrees. Examples of such angles include, but are not limited to, 0, 45, 90, 135, and 180 degrees.

Figure 8:
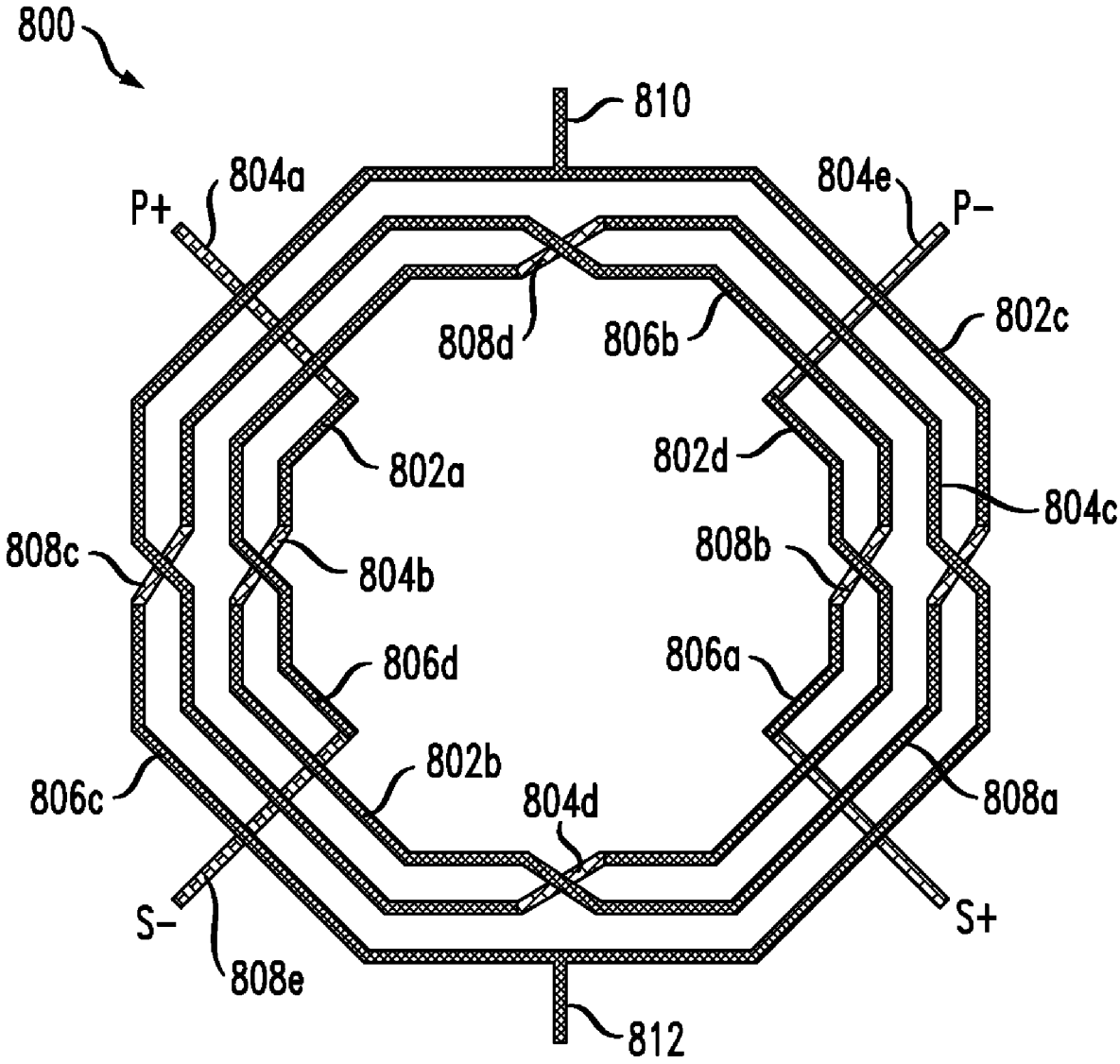
FIG. 8 is a top view of a BALUN with both inductors having non-integer number of turns and non-parallel ports in accordance with the present disclosure.

FIG. 8 illustrates a BALUN 800 having a turn ratio of 1.75:1.75. Features of BALUN 800 that are similar to features of transformer 700 shown in FIG. 7 are identified with reference numerals having the same two least significant digits and increased by 100. As shown in FIG. 8, the primary winding 802 of BALUN 800 makes 1.75 turns and includes ports 804*a* and 804*e* which are disposed at an angle of 90 degrees from one another. Similarly, secondary winding 806 makes 1.75 turns and has ports 808*a* and 808*e*, which are located 90 degrees from one another.

In some embodiments, the ports 804*a*, 804*e*, 808*a*, and 808*e* of primary and secondary windings 802, 806 may be located at angles other than 90 degrees. Examples of angles at which the ports of the primary and secondary windings may be located includes, but are not limited to, 0, 45, 90, 135, and 180. BALUN 800 also includes a center tap 810 connected to primary winding segment 802*c* and a center tap 812 connected to secondary winding segment 806*c*. As shown in FIG. 8, both of the center taps 810, 812 are located at the outer-most portions of BALUN 800 which reduces the current density of the center taps in high current applications compared to center taps connected to the center of the BALUN 800.

Figure 9A:
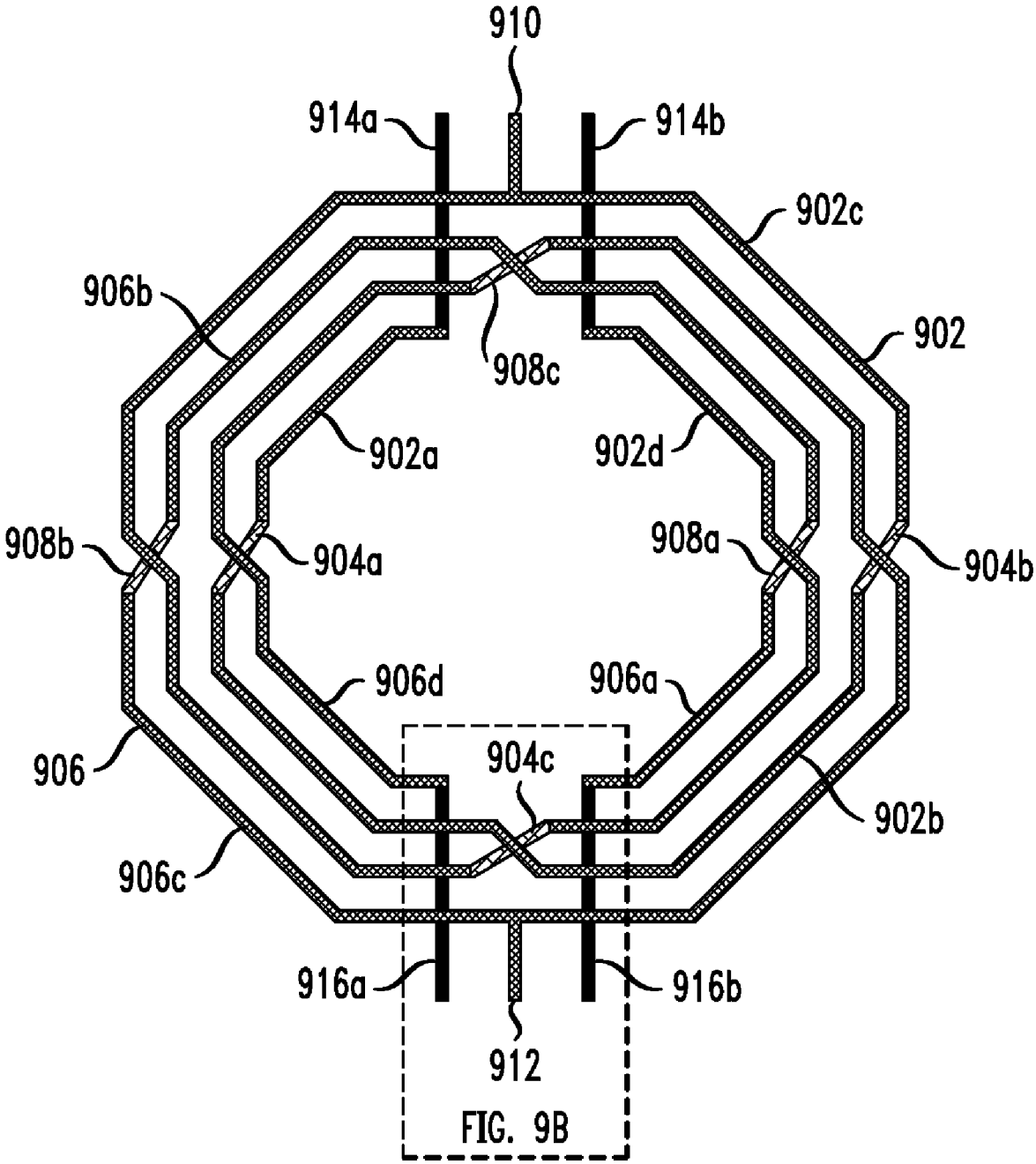
FIG. 9A is a top view of a transformer having a 2:2 turn ratio in accordance with the present disclosure.

In some embodiments, a BALUN or transformer may be formed using three metal layers. FIG. 9A is a top plan view of a transformer 900 having a 2:2 turn ratio that utilizes three metal layers in accordance with the present disclosure. As shown in FIG. 9A, transformer 900 includes a primary winding 902 comprising winding segments 902*a*, 902*b*, and 902*c*, which may be formed on a first metal layer 920 and a second metal layer 930. The primary winding segments 902*a*-902*c* are connected with bridges 904*a*, 904*b*, and 904*c*, which may be formed on the second metal layer 930.

Figure 9B:
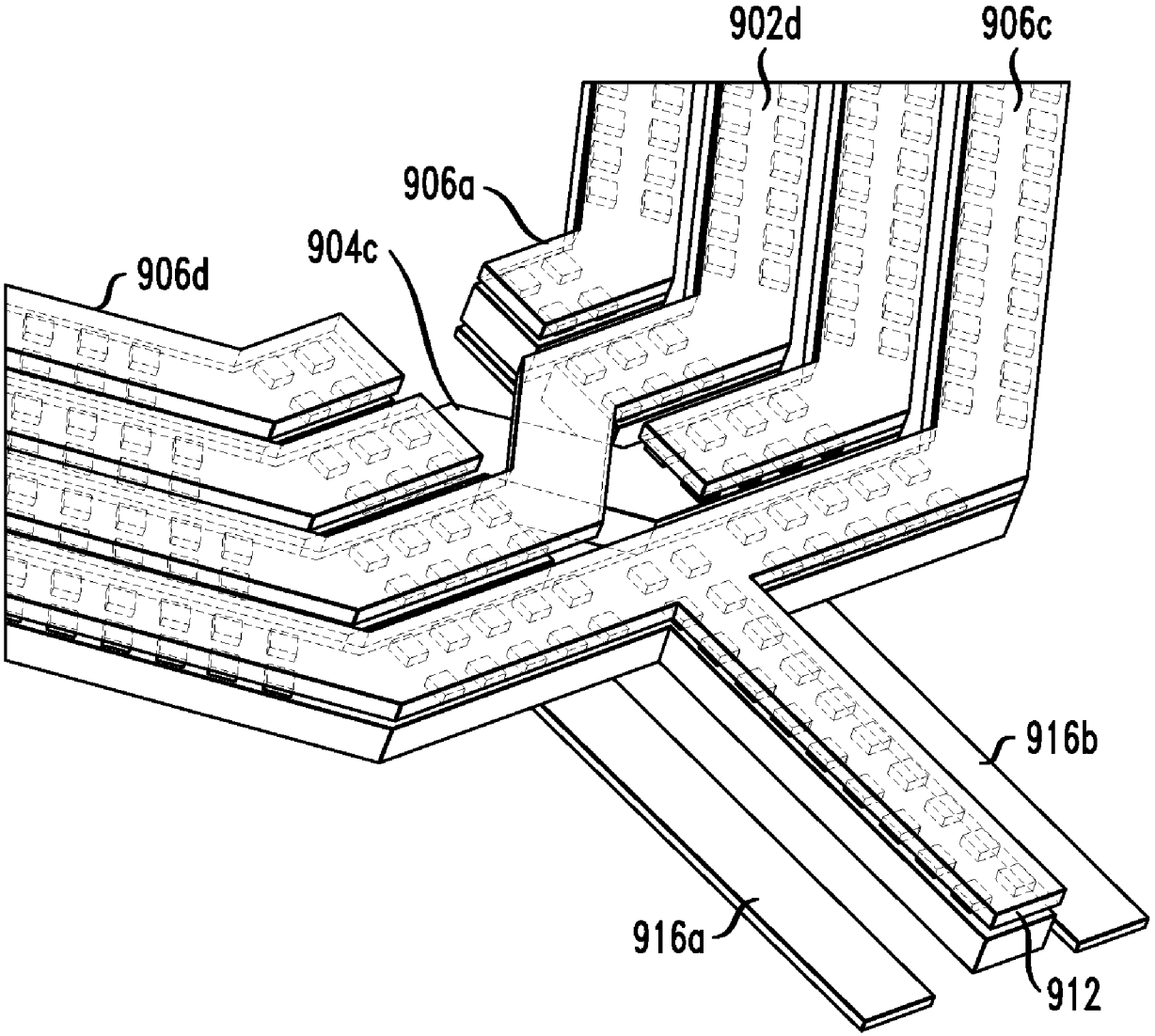
FIG. 9B is an isometric cross-sectional view of the transformer shown in FIG. 9A.
Figure 9C:
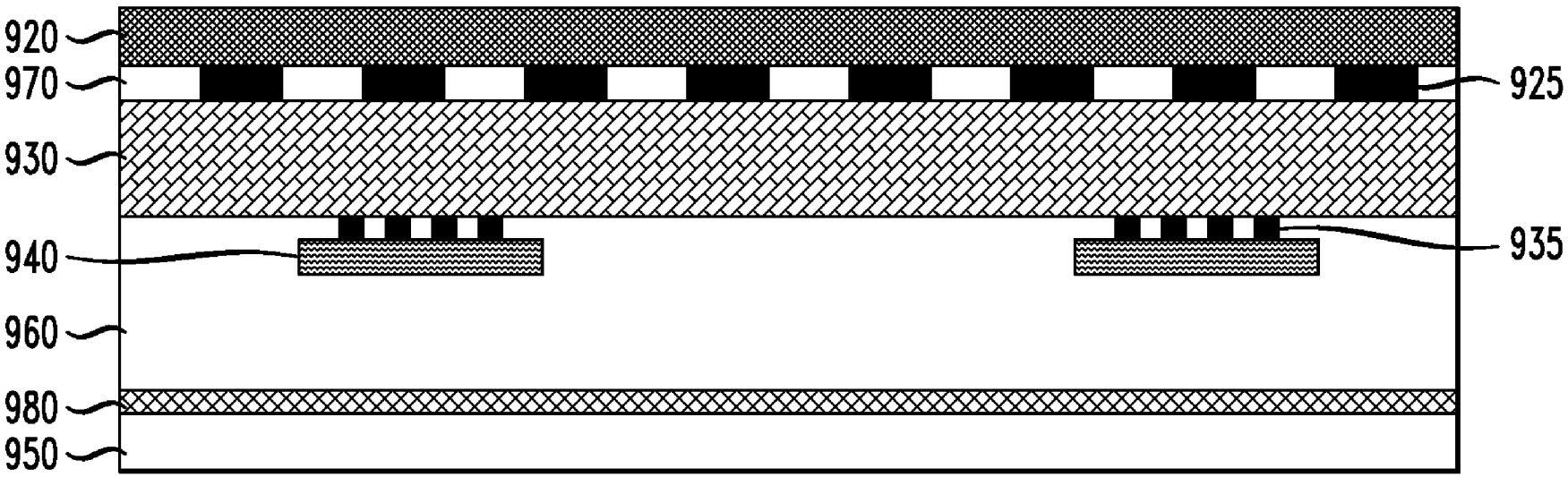
FIG. 9C is a cross-sectional view of the transformer illustrated in FIG. 9A.

Secondary winding 906 is also formed on the first metal layer 920 and second metal layer 930. Secondary winding segments 906*a*-906*d* are connected with bridges 908*a*, 908*b*, and 908*c*, which are formed on the second metal layer 930. The input ports 914*a*, 914*b* for primary winding 902 and input ports 916*a*, 916*b* for secondary winding 906 are formed on a third metal layer 940. As illustrated in FIGS. 9B and 9C, the third metal layer 940 may be formed below the first metal layer 920 and second metal layer 930.

FIG. 9C is a cross-sectional view of the transformer 900 illustrated in FIG. 9A. As shown in FIG. 9C, the two metal layers 920, 930 are vertically stacked over one another. In some embodiments, metal layers 920 and 930 are connected by one or more vias 925 formed in a first dielectric layer 970 that separates metal layers 920 and 930. A third metal layer 940 is formed below the first and second metal layers 920, 930 in dielectric layer 960. Examples of dielectric materials suitable for these layers include, but are not limited to, $SiO_2$, PSG, BPSG, and SiN. In some embodiments, one or more vias 935 may connect the second metal layer 930 and the third metal layer 940. The second dielectric layer 960 is formed over a guard ring 980, which is formed over a semiconductor substrate 950. In some embodiments, the first metal layer 920 has a thickness of approximately one micron, the second metal layer 930 has a thickness of approximately three microns, and the third metal layer 940 has a thickness of approximately 0.7 microns. One skilled in the art will understand that the vertical arrangement and thickness of the first, second, and third metal layers 920, 930, and 940 may be varied. Additionally, the metal layers 920, 930, 940 on which the primary winding 902, secondary winding 906, and the input ports 916*a*, 916*b* are formed may also be varied.

In some embodiments, the transformers and BALUNS enable a reduction in the number of processing steps, as each may be formed using only two metal layers while maintaining high Q-factors. In some embodiments, the transformers and BALUNS have improved reliability as the current density at the center of the devices which in turn reduces the likelihood of electromigration. In some embodiments, the transformers and BALUNS enable the ports of the primary and secondary windings to be located at various angles from one another providing improved flexibility with respect to where the transformers or BALUNS may be located on a chip in relation to other circuits. Additionally, the transformers and BALUNS may include windings with non-integer numbers of turns enabling the voltage to be stepped up or down at various increments using fewer windings and chip space.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. An electronic device, comprising:

a first winding having a first port and a second port, the first winding formed in a first metal layer formed over a semiconductor substrate; and a second winding having a third port and a fourth port, the second winding including a plurality of segments formed in the first metal layer, the plurality of winding segments of the second winding connected by a bridge formed at least partially in a second metal layer;

wherein the first and second ports of the first winding are disposed externally of the first and second windings and are directly connected to an innermost portion of the first winding.

2. The electronic device of claim 1, wherein the first winding includes a plurality of winding segments formed in the first metal layer, the plurality of winding segments of the first winding connected by a second bridge formed at least partially in the second metal layer.

3. The electronic device of claim 1, wherein the first winding is a primary winding and the second winding is a secondary winding.

4. The electronic device of claim 1, wherein the third and fourth ports are connected to an innermost portion of the second winding and are disposed externally of the first and second windings.

5. The electronic device of claim 3, wherein the third and fourth ports are connected to an outer-portion of the second winding.

6. The electronic device of claim 1, further comprising:

a first center tap connected to a winding segment of the first winding located at an outermost portion of the electronic device.

7. The electronic device of claim 6, wherein the first center tap is formed in the first metal layer.

8. The electronic device of claim 6, further comprising:

a second center tap connected to a winding segment of the second winding located at an outermost portion of the electronic device.

9. The electronic device of claim 8, wherein the second center tap is formed in the first metal layer.

10. The electronic device of claim 1, wherein the first winding has a non-integer number of turns.

11. The electronic device of claim 1, wherein the first port is non-parallel with the second port.

12. The electronic device of claim 11, wherein the third port is non-parallel with the fourth port.

13. The electronic device of claim 1, wherein the first metal layer has a thickness in a range from approximately one micron to approximately three microns.

14. The electronic device of claim 1, wherein the second metal layer has a thickness in a range from approximately one micron to approximately three microns.

15. A two metal-layer electronic device, comprising:

a primary winding having a first set of ports, the primary winding including:

a first plurality of winding segments formed in a first metal layer of the two metal layers in which the electronic device is formed over a semiconductor substrate; and a first plurality of bridges formed in a second metal layer of the two metal layers in which the electronic device is formed, the first plurality of bridges connecting the first plurality of winding segments; and a secondary winding having a second set of ports, the secondary winding including:

a second plurality of winding segments formed in the first metal layer; and a second plurality of bridges formed in the second metal layer, the second plurality of bridges connecting the second plurality of winding segments, wherein the first set of ports are disposed externally of the first and second windings and are directly connected to an innermost portion of the primary winding.

16. The electronic device of claim 1, wherein the first metal layer is vertically displaced from the second metal layer with a dielectric layer therebetween.

17. The electronic device of claim 15, further comprising:

a center tap connected to one of the plurality of winding segments of the primary winding, the winding segment to which the center tap is connected located at the outermost portion of the primary winding.

18. The electronic device of claim 17, further comprising:

a second center tap connected to one of the plurality of winding segments of the secondary winding, the winding segment to which the second center tap is connected located at the outermost portion of the secondary winding.

* * * * *